United States Patent [19]

Lerner et al.

[11] 4,353,049

[45] Oct. 5, 1982

[54] MAGNETICALLY DETENTED ROTARY SWITCH

[75] Inventors: Irwin S. Lerner, Orange; Melvin Spat, Stamford, both of Conn.

[73] Assignee: Lerner Laboratories, Inc., New Haven, Conn.

[21] Appl. No.: 181,707

[22] Filed: Aug. 27, 1980

[51] Int. Cl.[3] ..... H01H 9/20; H01H 5/02

[52] U.S. Cl. ..... 335/205; 335/153; 335/207; 200/67 F

[58] Field of Search ..... 335/205, 153, 206, 207, 335/1; 200/67 F, 61.45 M

[56] References Cited

U.S. PATENT DOCUMENTS

| | | | |
|---|---|---|---|
| 2,802,204 | 8/1957 | Kennelly et al. | 200/61.45 M X |
| 2,981,809 | 4/1961 | Van Horn | 200/61.45 M X |
| 3,233,061 | 2/1966 | Jones | 200/67 F X |
| 3,703,695 | 11/1972 | Mogi | 335/1 |

FOREIGN PATENT DOCUMENTS

| | | |
|---|---|---|
| 797169 | 6/1958 | United Kingdom . |
| 1378326 | 12/1974 | United Kingdom . |

*Primary Examiner*—L. T. Hix
*Assistant Examiner*—Stafford D. Schreyer
*Attorney, Agent, or Firm*—Hubbell, Cohen, Stiefel & Gross

[57] ABSTRACT

A two position rotary type magnetically actuated reed switch (10) having magnetic detents is disclosed. The preferred switch includes a housing (12) having confronting magnetizable side walls (13, 14), a shaft (22) secured to the housing (12) for rotation relative thereto and means (30) at one end of the shaft (22) for effecting manual rotation thereof, a magnetic member (36) secured to the shaft (22) for rotation therewith between the confronting walls (13, 14) whereby the member (36) is in magnetic detented contact with one wall (14) when the shaft (22) is rotated to a first position and in magnetic detented contact with the other wall (13) when the shaft (22) is rotated to a second position, and a magnetic reed switch (60) supported in the housing (12) in the vicinity of the wall (14) such that the switch (60) is activated when the shaft (22) is in its first position and deactivated when the shaft (22) is in its second position.

12 Claims, 6 Drawing Figures

MAGNETICALLY DETENTED ROTARY SWITCH

TECHNICAL FIELD

This invention pertains to magnetically actuated reed switches and more particularly to a two position rotary type magnetically actuated reed switch having magnetic detents.

BACKGROUND ART

Switches including magnetic reeds actuated by movement of a permanent magnet incorporated in a switch mechanism are known. For example, U.S. Pat. No. 3,265,826 issued to Autry et al discloses a three position rocker type switch including permanent magnets as part of the rocker assembly. As the rocker is manipulated from one position to the next, the permanent magnets move relative to a pair of stationary magnetic reeds whereby the reeds are actuated and deactuated. In the Autry et al device, a conventional spring biased ball and detent arrangement in the bottom of the rocker assembly defines the three switch positions.

U.S. Pat. No. 3,233,061 issued to Jones, Jr. discloses a magnetic reed which is actuated by a momentary push button type mechanism having a permanent magnet secured to the underside thereof. When the push button is depressed, the magnet moves toward the reed thereby closing the contacts thereof. Upon release, the push button and attached magnet return to their initial, undepressed positions whereupon the reed contacts open. In the undepressed position, the permanent magnet abuts and is attracted to a ferromagnetic mounting panel. The magnetic attraction between the magnet and the mounting panel defines a magnetic detent which maintains the push button in its undepressed position. Other switches wherein a magnetic reed is operable by movement of a permanent magnet are disclosed in U.S. Pat. Nos. 3,921,108, 3,176,097, 3,400,347, 3,974,464, 3,824,512, 3,305,805, and 3,356,948.

Also known in the art are switches incorporating magnetic reeds and permanent magnets, wherein the magnet is stationary and the reed is operable by selectively positioning a ferromagnetic member between the magnet and the reed. This type of switch is disclosed in U.S. Pat. No. 3,390,362 issued to Hoeppel and U.S. Pat. No. 3,201,537 issued to Klatte et al.

DISCLOSURE OF THE INVENTION

According to the invention, we have developed a novel two position rotary switch including a magnetic reed operable by a movable permanent magnet, wherein the magnet cooperates with confronting magnetizable side walls of the switch housing to establish detent type switch operation without the usual detent mechanisms.

In a preferred embodiment, a shaft is rotatably supported at the narrow end of a substantially wedge-shaped steel housing having confronting side walls. A magnetic member is secured to the shaft for rotation therewith such that the magnetic member contacts one side wall when the shaft is rotated in one direction, and the other side wall when the shaft is rotated in the other direction. A magnetic reed switch is supported in the housing near one of the side walls, such that when the magnetic member contacts that side wall, its magnetic field actuates the reed. The reed is deactuated by rotating the shaft to move the magnetic member into contact with the other side wall, thereby reducing the strength of the magnetic field in the vicinity of the reed.

The preferred magnetic member comprises a magnet and a ferromagnetic striker plate. The striker is secured to the magnet such that the magnet lies between the striker and the reed whereby the striker concentrates the magnetic field in the vicinity of the reed in a well known manner. The striker is preferably slightly wider than the magnet such that the striker alone contacts the side walls in the two switch positions. The striker is preferably secured to the magnet for movement relative thereto, such that the striker self-aligns with the side walls upon contact.

The two extreme rotated positions of the magnetic member define the two switch positions. In both switch positions, the magnetic member is in contact with one of the ferromagnetic side walls, and the attraction between the magnetic member and the side wall establishes a magnetic detent which holds the magnetic member to the side wall. Consequently, accidental movement of the switch from one position to the other is avoided. Also, the magnetic detent gives the switch a detent "feel" as the shaft is rotated to move the switch from one position to the other. Movement of the switch into each position is also clearly indicated to the user, by both sound and feel, as the magnetic member strikes the side walls of the housing. Furthermore, by using the magnetic member and steel side walls to define the two switch positions, the switch is capable of operating through a high number of cycles without any loss of reliability or detent "feel" due to mechanical wear.

In a modified embodiment, a permanent magnet is secured to the housing in the vicinity of the magnetic reed switch and a ferromagnetic member is secured to the shaft for rotation therewith between the confronting side walls of the housing. In one position, the ferromagnetic member contacts one side wall and is interposed between the permanent magnet and the reed switch, thereby sufficiently diverting the magnetic field from the magnet to deactuate the switch. In the other position, the ferromagnetic member is in contact with the other side wall and is not interposed between the magnet and the reed in which position the magnetic field from the magnet is sufficiently strong to actuate the reed.

When the ferromagnetic member is between the magnet and the reed switch, the ferromagnetic member is magnetized, and a magnetic detent is established between the ferromagnetic member and the contacted side wall. When the shaft is rotated to move the member into contact with the other side wall to actuate the reed, there is little or no magnetic attraction and hence no magnetic detent. However, if desired, a magnetic detent may be provided by securing a permanent magnet to the side wall contacted by the ferromagnetic member in the actuated switch position.

These as well as other features and advantages of the switch according to the invention will be more fully apparent from the following detailed description and annexed drawings of the presently preferred embodiments thereof.

BEST MODE FOR CARRYING OUT THE INVENTION

Figure 1:
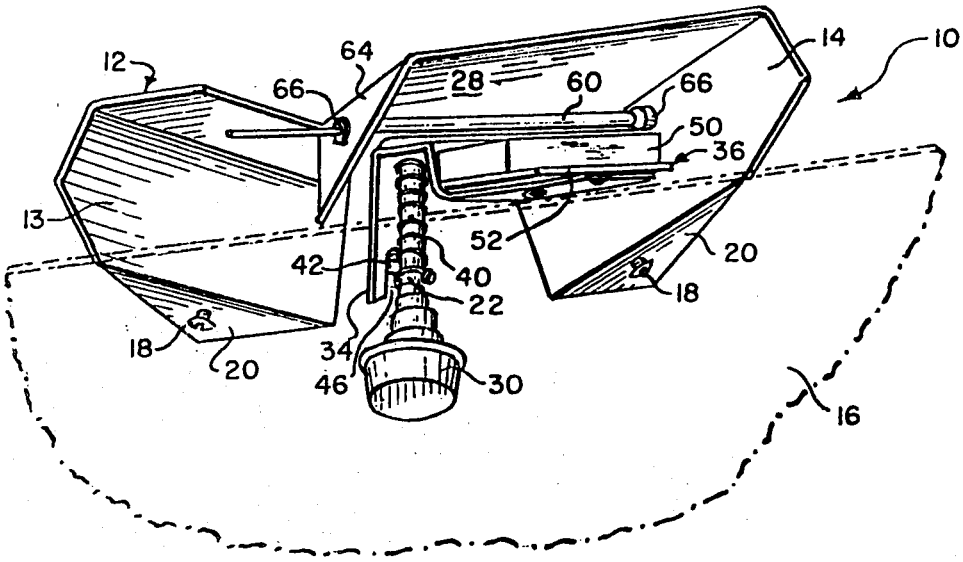
FIG. 1 is a perspective view of the preferred switch in accordance with the present invention.
Figure 2:
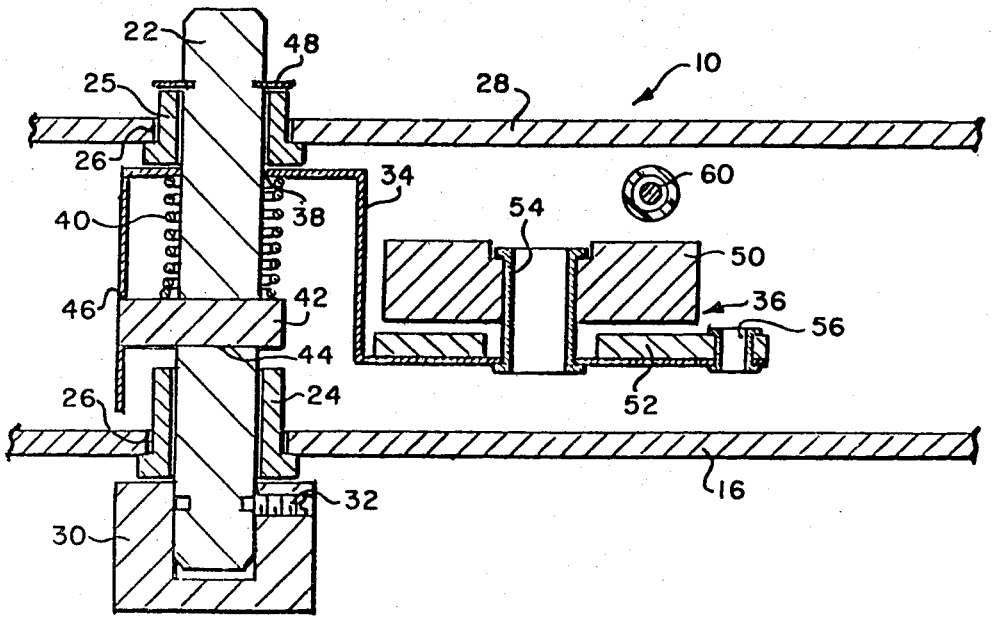
FIG. 2 is a vertical section of the switch illustrated in FIG. 1.
Figure 3:
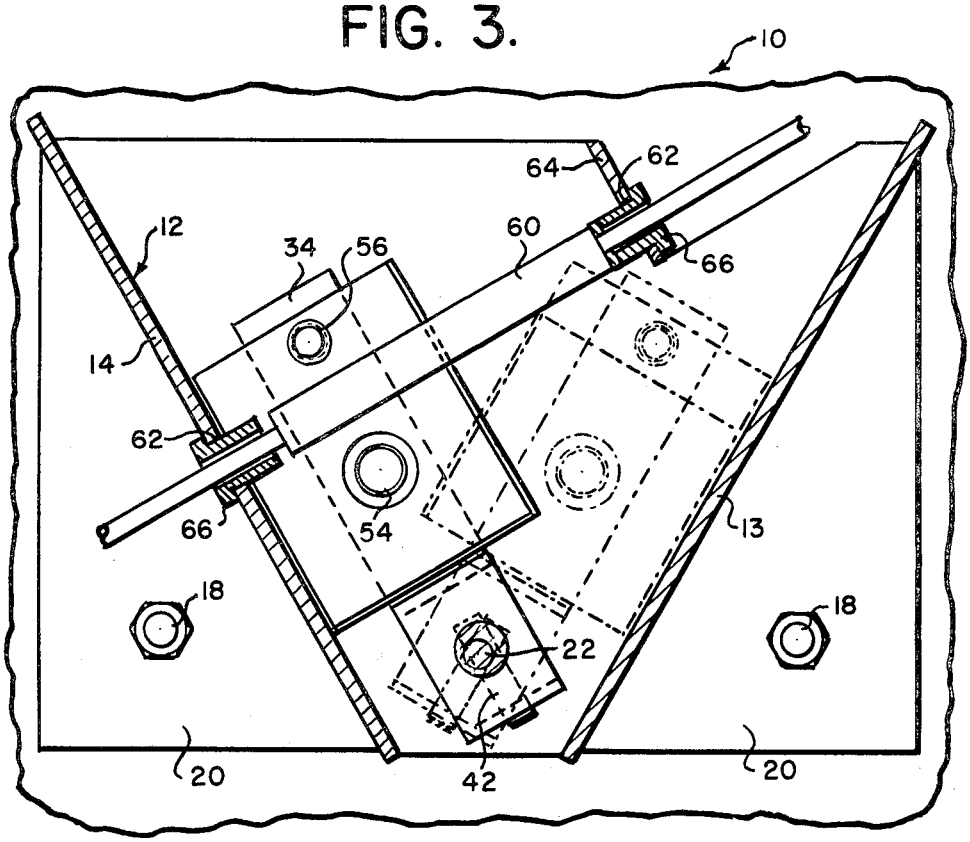
FIG. 3 is a horizontal section of the switch illustrated in FIG. 1, partly in phantom, showing the two switch positions.

Referring now to the drawings, and initially to FIGS. 1–3 thereof, a preferred embodiment of a switch in accordance with the present invention is generally designated at 10.

Switch 10 includes a generally wedge-shaped bracket 12 having confronting, magnetizable side walls 13, 14. Preferably, the entire bracket 12 is comprised of a ferromagnetic substance, such as steel. Typically, and as shown, the bracket 12 will be secured to the chassis 16 of the device in which the switch 10 is incorporated. By way of example, the bracket 12 may be secured to the chassis 16 by screws 18 extending through aligned holes in the chassis and bracket flanges 20. In FIGS. 1–3, bracket 12 and the confronting portion of chassis 16 collectively define the switch housing.

A shaft 22 is supported for rotation relative to the housing, preferably at the narrow end of the wedge-shaped bracket 12. As shown, the ends of the shaft 22 are preferably seated in journal bearings 24, 25 which are secured, as by a frictional fit, in aligned holes 26 in the chassis 16 and the bottom wall 28 of bracket 12. The shaft 22 may be manually rotated by a knob 30 secured, as by a set screw 32, to the free end of the shaft extending through the chassis 16.

A mounting bracket 34 for a magnetic member 36 is secured to shaft 22 for rotation therewith. As preferred and shown, the shaft 22 extends through a hole 38 in the bracket 34. A pin 42 seated in a hole 44 in the shaft 22 extends through a slot 46 in the bracket 34, it thus being apparent that rotation of knob 30 rotates shaft 22 and hence pin 42 and bracket 34. Sliding of the bracket along the shaft 22 is avoided by a coil spring 40 disposed about shaft 22 between the pin 42 and the bracket 34. A retaining ring 48 prevents axial movement of the shaft 22 toward the chassis 16 under the urging of spring 40 acting on pin 42.

As shown, the magnetic member 36, comprising a permanent magnet 50 and a ferromagnetic striker plate 52, is preferably secured to the bracket 34 by a rivet 54 extending through aligned holes in the magnetic member and bracket. As will be more fully apparent hereinafter, to accommodate self alignment of the striker plate 52, the aligned hole in the striker plate is preferably somewhat enlarged. For the same reason, striker plate 52 is preferably longer than magnet 50 in order that the striker plate may be independently secured to the outboard end of the bracket 34 as by rivet 56. Those skilled in the art will appreciate that the magnetic field established by the permanent magnet 50 is strengthened by the presence of the ferromagnetic striker plate 52.

A magnetic reed switch 60 is supported in the bracket 12 in the vicinity of the side wall 14. The magnetic reed switch 60 is preferably supported at its ends which extend through aligned holes 62 in the wall 14 and flange 64, the latter preferably being integral with and extending upwardly from the bottom wall 28 of the bracket 12. The conductive leads of the magnetic reed switch 60 are preferably insulated from the bracket 12 by plastic or other non-conducting bushings 66 seated in holes 62.

As noted, rotation of knob 30 rotates shaft 22 and hence bracket 34 and magnetic member 36 secured thereto. As best shown in FIGS. 1 and 3, when the knob 30 is rotated in a clockwise direction, the magnetic member 36 also rotates clockwise until it strikes side wall 14 of bracket 12, thereby indicating to the user that the fully clockwise switch position has been reached. Actually, only the striker plate 52 of the magnetic member 36 strikes the side wall 14. For this purpose, the striker plate 52 is slightly wider than the magnet 50. It will be apparent to those skilled in the art, however, that the striker plate 52 may be eliminated in which event the magnet 50 would itself contact the side wall.

As the striker plate 52 strikes the side wall 14, the combination of the enlarged hole in the striker plate 52 about the rivet 54 and the pivot point established by the rivet 56 permit the striker plate to align itself flush against the wall 14. This establishes a firm magnetic contact between the magnetic member 36 and the steel side wall 14 whereby a magnetic detent secures the magnetic member 36 to the wall. In this position, it will be apparent that the magnetic member 36 is in close spaced relation from the magnetic reed switch 60. Consequently, assuming the reed switch 60 is of the type having normally open contacts, the contacts thereof will close.

To deactivate the switch, the knob 30 is rotated in a counterclockwise direction. Because of the magnetic detent securing the magnetic member 36 to the side wall 14, the switch will present a detent feel to the user as the knob begins to move away from its fully clockwise position. Rotation continues until the striker plate 52 strikes the side wall 13, thereby indicating to the user that the fully counterclockwise switch position has been reached. As the striker plate 52 strikes the wall 13, the striker self aligns flush with the wall 13 in the manner described above. This establishes a magnetic detent for securing plate 52 to the wall 13. In this position, the magnetic field established by the magnetic member 36 is sufficiently weak in the vicinity of magnetic reed switch 60 that the contacts thereof return to their normally open position.

Due to the magnetic detent securing the magnetic member 36 to side wall 13, when the knob 30 is rotated clockwise to again close the switch 60, a detent feel is presented to the user as the knob moves away from its fully counterclockwise position. It will thus be apparent that the switch of the present invention operates in the manner of a two position rotary detent type switch without the usual structural elements required to establish detent type operation.

Also, because the current carrying contacts of the magnetic reed switch 60 are isolated from the surrounding environment, the switch of the invention is ideally suited for use in hazardous environments. For example, the switch may be used to actuate a fan in an exhaust system for removing toxic fumes from laboratory closures and the like.

Figure 4:
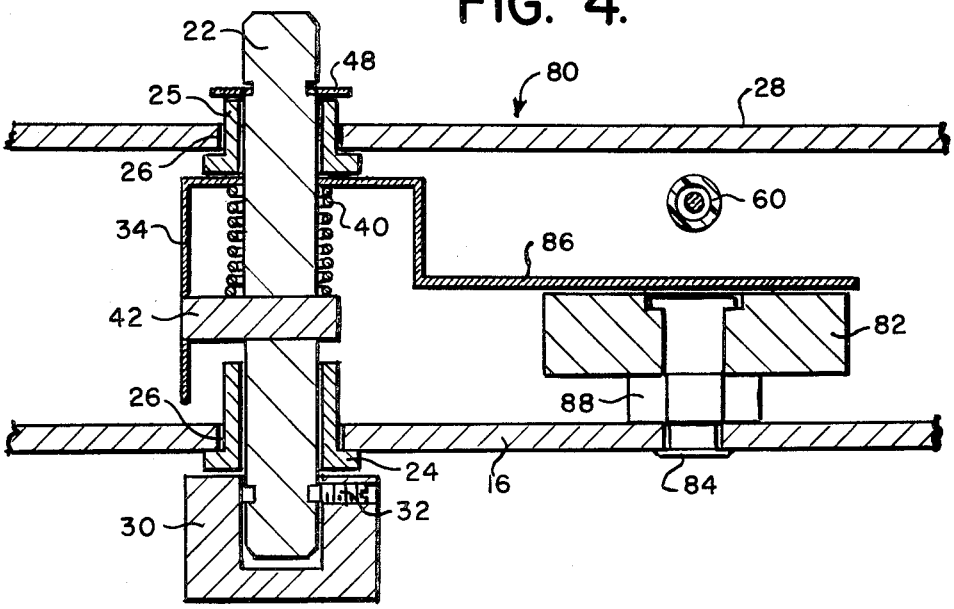
FIG. 4 is a view similar to FIG. 2 but showing an alternative switch embodiment.
Figure 5:
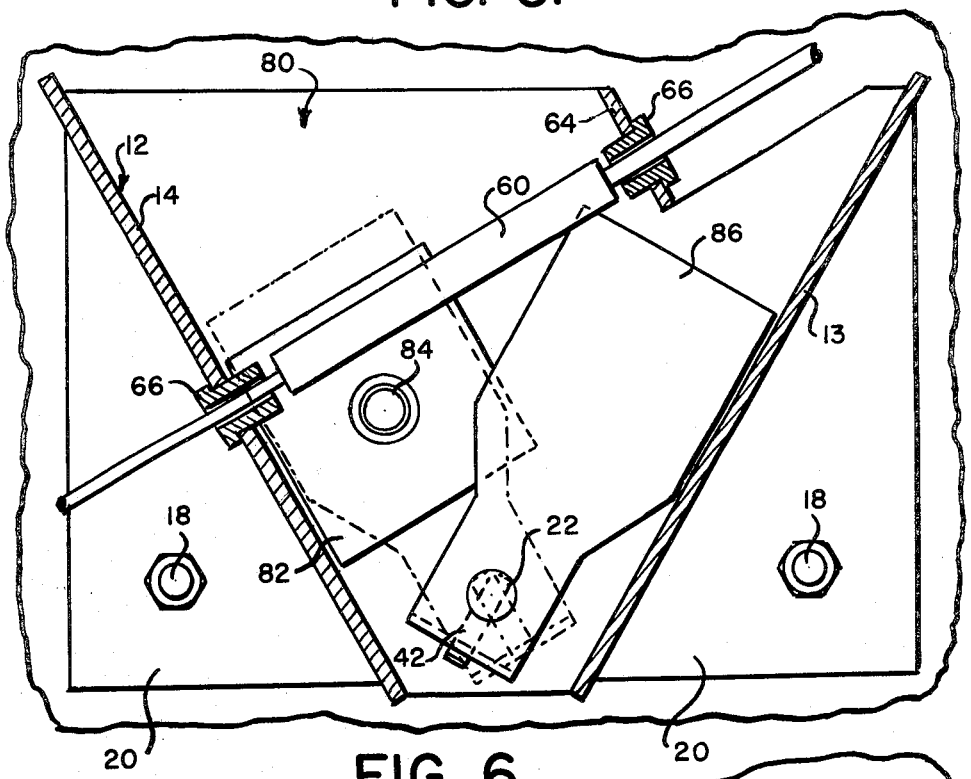
FIG. 5 is a view similar to FIG. 3, showing the two switch positions for the switch embodiment illustrated in FIG. 4.

Referring now to FIGS. 4 and 5, an alternative embodiment of a switch in accordance with the present invention is illustrated. Except for its magnetic member, the switch 80 of FIGS. 4–5 is in all respects identical to the switch 10 illustrated in FIGS. 1–3. Accordingly, a description of the common elements is omitted.

As shown in FIGS. 4–5, a permanent magnet 82 is fixedly secured, as by rivet 84, to chassis 16 adjacent side wall 14 in the vicinity of magnetic reed switch 60. Opening and closing of the contacts of the magnetic reed switch 60 is effected by a magnetizable interposer 86, which preferably comprises the outboard end of the bracket 34, which is enlarged for this purpose. While it is only necessary that the outboard end of the bracket 34 be magnetizable, preferably the entire bracket 34 is magnetizable, and most preferably it is made of steel.

It will be apparent that when the knob 30 and hence bracket 34 are rotated in a clockwise direction, the interposer 86 comes to rest in abutting relation with the side wall 14. In this position the interposer 86 is interposed between the magnetic reed switch 60 and the magnet 82 thereby sufficiently diverting the magnetic field therebetween to open the contacts of the magnetic reed switch. To close the switch, the knob and hence bracket 34 are rotated in the counterclockwise direction until the interposer 86 strikes the side wall 13, in which position the magnet 82 is separated from the magnetic reed switch 60 solely by an air gap and the strength of the magnetic field from the magnet 82 is sufficiently strong to close the contacts of the switch. To insure that the magnet 82 is sufficiently close to the switch 60 to close the contacts thereof when the interposer 86 is removed, it may be necessary to employ a standoff 88 between magnet 82 and chassis plate 16.

Figure 6:
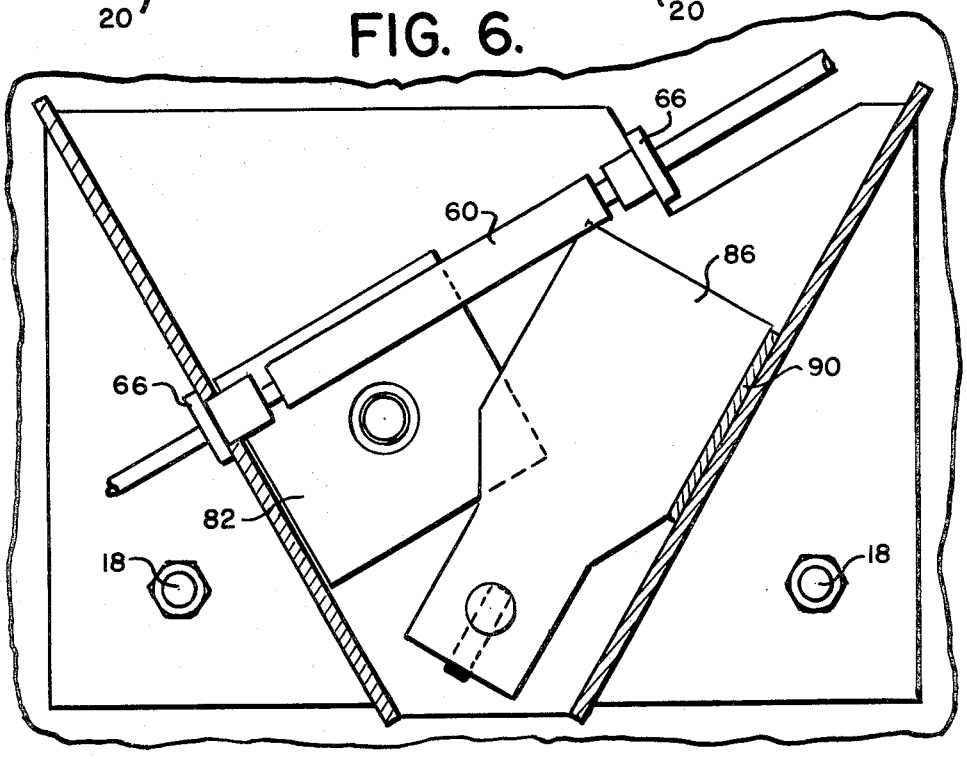
FIG. 6 is a view similar to FIG. 5 but showing a modification of the embodiment illustrated in FIGS. 4 and 5.

It will be apparent that the switch 80 of FIGS. 4–5 will present a detent feel to the user as the interposer 86 strikes the side walls 13 and 14. Because the interposer 86 becomes magnetized when in the vicinity of magnet 82, a magnetic detent is established when the interposer abuts the wall 14. Consequently, a detent feel is also presented when the knob 30 is rotated counterclockwise to move the interposer out of abutting relation with the wall 14. However, when the knob 30 is rotated clockwise to move interposer 86 out of abutting relation with wall 13, there will be no detent feel because of the lack of magnetic attraction between the interposer 86 and the wall 13. If desired, a magnetic detent between interposer 86 and wall 13 may be added by securing a magnet 90 to the wall 13 (FIG. 6) such that the interposer 86 strikes the magnet.

While I have herein shown and described the preferred embodiments of a switch in accordance with the present invention, those skilled in the art will appreciate that numerous changes and modifications may be made therein without departing from the spirit and scope of the invention. Accordingly, the above description is to be construed as illustrative and not in a limiting sense, the scope of the invention being defined by the following claims:

We claim:

1. A switch comprising:

a housing having two confronting magnetizable walls;

a shaft secured to said housing for rotation relative thereto; means at one end of said shaft for effecting manual rotation thereof;

a magnetic member; means for securing said magnetic member to said shaft for rotation therewith between said confronting walls, whereby said magnetic member is in magnetic detented contact with one of said magnetizable walls when said shaft is rotated to a first position and in magnetic detented contact with the confronting magnetizable wall when said shaft is rotated to a second position; and a magnetic reed switch supported in said housing in the vicinity of said one magnetizable wall, whereby said switch is activated when said shaft is in said first position and deactivated when said shaft is in said second position.

2. The switch according to claim 1, wherein said magnetic member comprises a magnet.

3. The switch according to claim 2, wherein said magnet has an upper face and a lower face, said upper face confronting said reed switch when said shaft is in said first position; and wherein said magnetic member further comprises a ferromagnetic member secured to the lower face of said magnet.

4. The switch according to claim 3, wherein said ferromagnetic member is wider than said magnet whereby only said ferromagnetic member contacts said magnetizable walls; and further comprising means for accommodating self-alignment of said ferromagnetic member with said walls.

5. The switch according to claim 4, wherein said housing is substantially wedge-shaped and said confronting walls are non-parallel.

6. The switch according to claim 5, wherein said housing is ferromagnetic.

7. The switch according to claim 6, wherein said means for securing said magnetic member to said shaft comprises a bracket secured at one end to said shaft and at the other end to said magnetic member.

8. A switch comprising:

a housing having two confronting walls, at least one of which is magnetizable;

a shaft secured to said housing for rotation relative thereto; means at one end of said shaft for effecting manual rotation thereof;

a magnet secured to said housing in the vicinity of said magnetizable wall;

a magnetic reed switch supported in said housing in the vicinity of said magnet;

a magnetizable member; means for securing said magnetizable member to said shaft for rotation therewith between a first position wherein said magnetizable member is in magnetic detented contact with said magnetizable wall and interposed between said magnet and said reed switch, and a second position wherein said magnetizable member is in abutting relation with the other wall and not interposed between said magnet and said reed switch, whereby said reed switch is deactuated when said magnetizable member is in said first position and actuated when said magnetizable member is in said second position.

9. The switch according to claim 8, wherein said magnetizable member is ferromagnetic.

10. The switch according to claim 9, wherein said housing is substantially wedge-shaped and said confronting walls are non-parallel.

11. The switch according to claim 10, wherein said means for securing said magnetizable member to said shaft comprises a bracket secured at one end to said shaft, the other end of said bracket comprising said magnetizable member.

12. The switch according to claim 10, further comprising an additional magnet secured to said other wall whereby said magnetizable member is in magnetic detented contact with said other wall when said member is in said second position.

* * * * *